US009019318B2

(12) United States Patent
Sprague et al.

(10) Patent No.: US 9,019,318 B2
(45) Date of Patent: Apr. 28, 2015

(54) DRIVING METHODS FOR ELECTROPHORETIC DISPLAYS EMPLOYING GREY LEVEL WAVEFORMS

(75) Inventors: Robert A. Sprague, Saratoga, CA (US); Craig Lin, San Jose, CA (US); Tin Pham, San Jose, CA (US); Manasa Peri, Milpitas, CA (US)

(73) Assignee: E Ink California, LLC, Fremont, CA (US)

( * ) Notice: Subject to any disclaimer, the term of this patent is extended or adjusted under 35 U.S.C. 154(b) by 245 days.

(21) Appl. No.: 12/852,404

(22) Filed: Aug. 6, 2010

(65) Prior Publication Data

US 2010/0295880 A1 Nov. 25, 2010

Related U.S. Application Data

(63) Continuation-in-part of application No. 12/632,540, filed on Dec. 7, 2009, now Pat. No. 8,558,855, which is a continuation-in-part of application No. 12/604,788, filed on Oct. 23, 2009, now abandoned.

(60) Provisional application No. 61/108,468, filed on Oct. 24, 2008, provisional application No. 61/108,440, filed on Oct. 24, 2008.

(51) Int. Cl.

| | |
|---|---|
| ***G09G 5/10*** | (2006.01) |
| ***G09G 3/34*** | (2006.01) |
| ***G09G 3/20*** | (2006.01) |

(52) U.S. Cl.

CPC ..... *G09G 3/344* (2013.01); *G09G 3/2014* (2013.01); *G09G 2310/0254* (2013.01); *G09G 2310/061* (2013.01)

(58) Field of Classification Search

USPC ..... 345/690, 692

See application file for complete search history.

(56) References Cited

U.S. PATENT DOCUMENTS

| | | | |
|---|---|---|---|
| 4,143,947 | A | 3/1979 | Aftergut et al. |
| 4,259,694 | A | 3/1981 | Liao |
| 4,443,108 | A | 4/1984 | Webster |
| 4,568,975 | A | 2/1986 | Harshbarger et al. |
| 4,575,124 | A | 3/1986 | Morrison et al. |
| 5,266,937 | A | 11/1993 | DiSanto et al. |

(Continued)

FOREIGN PATENT DOCUMENTS

| | | |
|---|---|---|
| TW | 200625223 | 7/2006 |
| WO | WO 01/67170 | 9/2001 |

(Continued)

OTHER PUBLICATIONS

Allen, K. (Oct. 2003). Electrophoretics Fulfilled. *Emerging Displays Review: Emerging Display Technologies*, Monthly Report—Oct. 2003, 9-14.

(Continued)

*Primary Examiner* — Gerald Johnson
(74) *Attorney, Agent, or Firm* — Perkins Coie LLP

(57) ABSTRACT

This application is directed to driving methods for electrophoretic displays. The driving methods comprise grey level waveforms which greatly enhance the pictorial quality of images displayed. The driving method comprises: (a) applying waveform to drive each pixel to the full first color then to a color state of a desired level; or (b) applying waveform to drive each pixel to the full second color then to a color state of a desired level.

14 Claims, 11 Drawing Sheets

(56) References Cited

U.S. PATENT DOCUMENTS

| | | | | |
|---|---|---|---|---|
| 5,298,993 | A | 3/1994 | Edgar et al. | |
| 5,754,584 | A | 5/1998 | Durrant et al. | |
| 5,831,697 | A | 11/1998 | Evanicky et al. | |
| 5,923,315 | A | 7/1999 | Ueda et al. | |
| 5,926,617 | A | 7/1999 | Ohara et al. | |
| 6,005,890 | A | 12/1999 | Clow et al. | |
| 6,045,756 | A | 4/2000 | Carr et al. | |
| 6,069,971 | A | 5/2000 | Kanno et al. | |
| 6,075,506 | A | 6/2000 | Bonnett et al. | |
| 6,111,248 | A | 8/2000 | Melendez et al. | |
| 6,154,309 | A | 11/2000 | Otani et al. | |
| 6,504,524 | B1 | 1/2003 | Gates et al. | |
| 6,531,997 | B1 | 3/2003 | Gates et al. | |
| 6,532,008 | B1 | 3/2003 | Guralnick | |
| 6,639,580 | B1 | 10/2003 | Kishi et al. | |
| 6,657,612 | B2 | 12/2003 | Machida et al. | |
| 6,671,081 | B2 | 12/2003 | Kawai | |
| 6,674,561 | B2 | 1/2004 | Ohnishi et al. | |
| 6,686,953 | B1 | 2/2004 | Holmes | |
| 6,703,995 | B2 * | 3/2004 | Bird et al. | 345/87 |
| 6,760,059 | B2 | 7/2004 | Ham | |
| 6,796,698 | B2 | 9/2004 | Sommers et al. | |
| 6,903,716 | B2 | 6/2005 | Kawabe et al. | |
| 6,914,713 | B2 | 7/2005 | Chung et al. | |
| 6,927,755 | B2 | 8/2005 | Chang | |
| 6,930,818 | B1 | 8/2005 | Liang et al. | |
| 6,970,155 | B2 | 11/2005 | Cabrera | |
| 6,995,550 | B2 | 2/2006 | Jacobson et al. | |
| 7,046,228 | B2 | 5/2006 | Liang et al. | |
| 7,177,066 | B2 | 2/2007 | Chung et al. | |
| 7,184,196 | B2 | 2/2007 | Ukigaya | |
| 7,202,847 | B2 | 4/2007 | Gates | |
| 7,277,074 | B2 | 10/2007 | Shih | |
| 7,283,119 | B2 | 10/2007 | Kishi | |
| 7,307,779 | B1 | 12/2007 | Cernasov et al. | |
| 7,349,146 | B1 | 3/2008 | Douglass et al. | |
| 7,504,050 | B2 | 3/2009 | Weng et al. | |
| 7,528,822 | B2 | 5/2009 | Amundson et al. | |
| 7,701,423 | B2 | 4/2010 | Suwabe et al. | |
| 7,705,823 | B2 | 4/2010 | Nihei et al. | |
| 7,710,376 | B2 | 5/2010 | Edo et al. | |
| 7,733,311 | B2 | 6/2010 | Amundson et al. | |
| 7,773,069 | B2 | 8/2010 | Miyasaka et al. | |
| 7,800,580 | B2 | 9/2010 | Johnson et al. | |
| 7,804,483 | B2 | 9/2010 | Zhou et al. | |
| 7,816,440 | B2 | 10/2010 | Matsui | |
| 7,839,381 | B2 | 11/2010 | Zhou et al. | |
| 7,952,558 | B2 | 5/2011 | Yang et al. | |
| 7,995,029 | B2 | 8/2011 | Johnson | |
| 7,999,787 | B2 | 8/2011 | Amundson et al. | |
| 8,035,611 | B2 | 10/2011 | Sakamoto | |
| 8,044,927 | B2 | 10/2011 | Inoue | |
| 8,054,253 | B2 | 11/2011 | Yoo | |
| 8,102,363 | B2 | 1/2012 | Hirayama | |
| 8,125,501 | B2 | 2/2012 | Amundson et al. | |
| 8,274,472 | B1 | 9/2012 | Wang et al. | |
| 8,334,836 | B2 | 12/2012 | Kanamori et al. | |
| 2002/0021483 | A1 | 2/2002 | Katase | |
| 2002/0033792 | A1 | 3/2002 | Inoue | |
| 2003/0095090 | A1 | 5/2003 | Ham | |
| 2003/0137521 | A1 | 7/2003 | Zehner et al. | |
| 2003/0193565 | A1 | 10/2003 | Wen et al. | |
| 2004/0246562 | A1 | 12/2004 | Chung et al. | |
| 2004/0263450 | A1 | 12/2004 | Lee et al. | |
| 2005/0001812 | A1 | 1/2005 | Amundson et al. | |
| 2005/0024353 | A1 * | 2/2005 | Amundson et al. | 345/204 |
| 2005/0162377 | A1 | 7/2005 | Zhou et al. | |
| 2005/0179642 | A1 | 8/2005 | Wilcox et al. | |
| 2005/0185003 | A1 | 8/2005 | Dedene et al. | |
| 2005/0210405 | A1 | 9/2005 | Ernst et al. | |
| 2005/0219184 | A1 | 10/2005 | Zehner et al. | |
| 2005/0280626 | A1 * | 12/2005 | Amundson et al. | 345/107 |
| 2006/0050361 | A1 | 3/2006 | Johnson | |
| 2006/0125750 | A1 * | 6/2006 | Nose et al. | 345/88 |
| 2006/0132426 | A1 | 6/2006 | Johnson | |
| 2006/0139305 | A1 | 6/2006 | Zhou et al. | |
| 2006/0139309 | A1 | 6/2006 | Miyasaka | |
| 2006/0164405 | A1 * | 7/2006 | Zhou | 345/204 |
| 2006/0187186 | A1 | 8/2006 | Zhou et al. | |
| 2006/0232547 | A1 | 10/2006 | Johnson et al. | |
| 2006/0262147 | A1 | 11/2006 | Kimpe et al. | |
| 2006/0262384 | A1 | 11/2006 | Chung et al. | |
| 2006/0279501 | A1 * | 12/2006 | Lu et al. | 345/94 |
| 2007/0035510 | A1 | 2/2007 | Zhou et al. | |
| 2007/0046621 | A1 | 3/2007 | Suwabe et al. | |
| 2007/0046625 | A1 | 3/2007 | Yee | |
| 2007/0052668 | A1 | 3/2007 | Zhou et al. | |
| 2007/0070032 | A1 | 3/2007 | Chung et al. | |
| 2007/0080926 | A1 | 4/2007 | Zhou et al. | |
| 2007/0080928 | A1 | 4/2007 | Ishii et al. | |
| 2007/0091117 | A1 | 4/2007 | Zhou et al. | |
| 2007/0103427 | A1 | 5/2007 | Zhou et al. | |
| 2007/0109274 | A1 | 5/2007 | Reynolds | |
| 2007/0132687 | A1 | 6/2007 | Johnson | |
| 2007/0146306 | A1 | 6/2007 | Johnson et al. | |
| 2007/0159682 | A1 | 7/2007 | Tanaka et al. | |
| 2007/0182402 | A1 | 8/2007 | Kojima | |
| 2007/0188439 | A1 | 8/2007 | Kimura et al. | |
| 2007/0247417 | A1 | 10/2007 | Miyazaki et al. | |
| 2007/0262949 | A1 | 11/2007 | Zhou et al. | |
| 2007/0276615 | A1 | 11/2007 | Cao et al. | |
| 2007/0296690 | A1 | 12/2007 | Nagasaki | |
| 2008/0150886 | A1 | 6/2008 | Johnson et al. | |
| 2008/0158142 | A1 | 7/2008 | Zhou et al. | |
| 2008/0211833 | A1 | 9/2008 | Inoue | |
| 2008/0273022 | A1 | 11/2008 | Komatsu | |
| 2008/0303780 | A1 | 12/2008 | Sprague et al. | |
| 2009/0096745 | A1 | 4/2009 | Sprague et al. | |
| 2009/0267970 | A1 | 10/2009 | Wong et al. | |
| 2010/0134538 | A1 | 6/2010 | Sprague et al. | |
| 2010/0194733 | A1 | 8/2010 | Lin et al. | |
| 2010/0194789 | A1 | 8/2010 | Lin et al. | |
| 2010/0238203 | A1 | 9/2010 | Stroemer et al. | |
| 2010/0283804 | A1 | 11/2010 | Sprague et al. | |
| 2011/0096104 | A1 | 4/2011 | Sprague et al. | |
| 2011/0175945 | A1 | 7/2011 | Lin | |
| 2011/0216104 | A1 | 9/2011 | Chan et al. | |
| 2011/0298776 | A1 | 12/2011 | Lin | |

FOREIGN PATENT DOCUMENTS

| | | |
|---|---|---|
| WO | WO 2005/004099 | 1/2005 |
| WO | WO 2005/031688 | 4/2005 |
| WO | WO 2005/034076 | 4/2005 |
| WO | WO 2009/049204 | 4/2009 |
| WO | WO 2010/132272 | 11/2010 |

OTHER PUBLICATIONS

Bardsley, J.N. & Pinnel, M.R. (Nov. 2004) Microcup™ Electrophoretic Displays. *USDC Flexible Display Report*, 3.1.2. pp. 3-12-3-16.

Chaug, Y.S., Haubrich, J.E., Sereda, M. and Liang, R.C. (Apr. 2004). Roll-to-Roll Processes for the Manufacturing of Patterned Conductive Electrodes on Flexible Substrates. *Mat. Res. Soc. Symp. Proc.*, vol. 814, I9.6.1.

Chen, S.M. (Jul. 2003) The Applications for the Revolutionary Electronic Paper Technology. *OPTO News & Letters*, 102, 37-41. (in Chinese, English abstract attached).

Chen, S.M. (May 2003) The New Application and the Dynamics of Companies. *TRI*. 1-10. (in Chinese, English abstract attached).

Chung, J., Hou, J., Wang, W., Chu, L.Y., Yao, W., & Liang, R.C. (Dec. 2003). Microcup® Electrophoretic Displays, Grayscale and Color Rendition. *IDW*, AMD2/EP1-2, 243-246.

Ho, Andrew. (Nov. 2006) *Embedding e-Paper in Smart Cards, Pricing Labels & Indicators*. Presentation conducted at Smart Paper Conference Nov. 15-16, 2006, Atlanta, GA, USA.

Ho, C.,& Liang, R.C. (Dec. 2003). *Microcup ® Electronic Paper by Roll-to-Roll Manufacturing Processes*. Presentation conducted at FEG, Nei-Li, Taiwan.

Ho, Candice. (Feb. 1, 2005) *Microcupt® Electronic Paper Device and Applicaiton*. Presentation conducted at USDC 4th Annual Flexible Display Conference 2005.

(56) References Cited

OTHER PUBLICATIONS

Hou, J., Chen, Y., Li, Y., Weng, X., Li, H. and Pereira, C. (May 2004). Reliability and Performance of Flexible Electrophoretic Displays by Roll-to-Roll Manufacturing Processes. *SID Digest*, 32.3, 1066-1069.
Kao, WC., (Feb. 2009) Configurable Timing Controller Design for Active Matrix Electrophoretic Dispaly. *IEEE Transactions on Consumer Electronics*, 2009, vol. 55, Issue 1, pp. 1-5.
Kao, WC., Fang, CY., Chen, YY., Shen, MH., and Wong, J. (Jan. 2008) Intergrating Flexible Electrophoretic Display and One-Time Password Generator in Smart Cards. *ICCE 2008 Digest of Technical Papers*, P4-3. (Int'l Conference on Consumer Electronics, Jan. 9-13, 2008).
Kao, WC., Ye, JA., and Lin, C. (Jan. 2009) Image Quality Improvement for Electrophoretic Displays by Combining Contrast Enhancement and Halftoning Techniques. *ICCE 2009 Digest of Technical Papers*, 11.2-2.
Kao, WC., Ye, JA., Chu, MI., and Su, CY. (Feb. 2009) Image Quality Improvement for Electrophoretic Displays by Combining Contrast Enhancement and Halftoning Techniques. *IEEE Transactions on Consumer Electronics*, 2009, vol. 55, Issue 1, pp. 15-19.
Kao, WC., Ye, JA., Lin, FS., Lin, C., and Sprague, R. (Jan. 2009) Configurable Timing Controller Design for Active Matrix Electrophoretic Display with 16 Gray Levels. *ICCE 2009 Digest of Technical Papers*, 10.2-2.
Lee, H., & Liang, R.C. (Jun. 2003) SiPix Microcup® Electronic Paper —An Introduction. *Advanced Display*, Issue 37, 4-9 (in Chinese, English abstract attached).
Liang, R.C. (Feb. 2003) *Microcup® Electrophoretic and Liquid Crystal Displays by Roll-to-Roll Manufacturing Processes*. Presentation conducted at the Flexible Microelectronics & Displays Conference of U.S. Display Consortium, Phoenix, Arizona, USA.
Liang, R.C. (Apr. 2004). *Microcup Electronic Paper by Roll-to-Roll Manufacturing Process*. Presentation at the Flexible Displays & Electronics 2004 of Intertech, San Fransisco, California, USA.
Liang, R.C. (Oct. 2004) *Flexible and Roll-able Displays/Electronic Paper—A Technology Overview*. Paper presented at the METS 2004 Conference in Taipie, Taiwan.
Liang, R.C:, & Tseng, S. (Feb. 2003). *Microcup® LCD, A New Type of Dispersed LCD by A Roll-to-Roll Manufacturing Process*. Paper presented at the IDMC, Taipei, Taiwan.
Liang, R.C., (Feb. 2005) *Flexible and Roll-able Displays/Electronic Paper—A Brief Technology Overview*. Flexible Display Forum, 2005, Taiwan.
Liang, R.C., Hou, J., & Zang, H.M. (Dec. 2002) Microcup Electrophoretic Displays by Roll-to-Roll Manufacturing Processes. *IDW* , EP2-2, 1337-1340.
Liang, R.C., Hou, J., Chung, J., Wang, X., Pereira, C., & Chen, Y. (May 2003). Microcup® Active and Passive Matrix Electrophoretic Displays by A Roll-to-Roll Manufacturing Processes. *SID Digest*, vol. 34, Issue 1, pp. 838-841, 20.1.
Liang, R.C., Hou, J., Zang, H.M., & Chung, J. (Feb. 2003). *Passive Matrix Microcup® Electrophoretic Displays*. Paper presented at the IDMC, Taipei, Taiwan.
Liang, R.C., Hou, J., Zang, H.M., Chung, J., & Tseng, S. (2003). Microcup® displays : Electronic Paper by Roll-to-Roll Manufacturing Processes. *Journal of the SID*, 11(4), 621-628.
Liang, R.C., Zang, H.M., Wang, X., Chung, J. & Lee, H., (Jun./Jul. 2004) << Format Flexible Microcup® Electronic Paper by Roll-to-Roll Manufacturing Process >>, Presentation conducted at the 14th FPD Manufacturing Technology EXPO & Conference.
Nikkei Microdevices. (Dec. 2002) Newly-Developed Color Electronic Paper Promises—Unbeatable Production Efficiency. *Nikkei Microdevices*, p3. (in Japanese, with English translation).
Sprague, R.A. (Sep. 23, 2009) SiPix Microcup Electrophoretic Epaper for Ebooks. *NIP 25 Technical Programs and Proceedings*, 2009 pp. 460-462.
Wang, X., Kiluk, S., Chang, C., & Liang, R.C. (Feb. 2004). Mirocup® Electronic Paper and the Converting Processes. *ASID*, 10.1.2-26, 396-399, Nanjing, China.
Wang, X., Kiluk, S., Chang, C., & Liang, R.C., (Jun. 2004) Microcup® Electronic Paper and the Converting Processes. *Advanced Display*, Issue 43, 48-51 (in Chinese, with English abstract).
Wang, X., Li, P., Sodhi, D., Xu, T. and Bruner, S. et al., (Feb. 2006) *Inkjet Fabrication of Multi-Color Microcup® Electrophorectic Display*. the Flexible Microelectronics & Displays Conference of U.S. Display Consortium.
Wang, X., Zang, HM., and Li, P. (Jun. 2006) Roll-to-Roll Manufacturing Process for Full Color Electrophoretic film. *SID Digest*, 00pp. 1587-1589.
Zang, H.M, Hwang, J.J., Gu, H., Hou, J., Weng, X., Chen, Y., et al. (Jan. 2004). Threshold and Grayscale Stability of Microcup® Electronic Paper. *Proceeding of SPIE-IS&T Electronic Imaging, SPIE* vol. 5289, 102-108.
Zang, H.M. & Hou, Jack, (Feb. 2005) *Flexible Microcup® EPD by RTR Process*. Presentation conducted at 2nd Annual Paper-Like Displays Conference, Feb. 9-11, 2005, St. Pete Beach, Florida.
Zang, H.M. (Oct. 2003). *Microcup ® Electronic Paper by Roll-to-Roll Manufacturing Processes*. Presentation conducted at the Advisory Board Meeting, Bowling Green State University, Ohio, USA.
Zang, H.M. (Feb. 2004). *Microcup Electronic Paper*. Presentation conducted at the Displays & Microelectronics Conference of U.S. Display Consortium, Phoenix, Arizona, USA.
Zang, H.M., & Liang, R.C. (2003) Microcup Electronic Paper by Roll-to-Roll Manufacturing Processes. *The Spectrum*, 16(2), 16-21.
Zang, HM., (Feb. 2007) *Developments in Microcup® Flexible Displays*. Presentation conducted at the 6th Annual Flexible Display and Microelectronics Conference, Phoenix, AZ Feb. 6-8.
Zang, HM., (Sep. 2006) *Monochrome and Area Color Microcup®EPDs by Roll-to-Roll Manufacturing Process*. Presentation conducted at the Forth Organic Electronics Conference and Exhibition-(OEC-06), Sep. 25-27, 2006, Frankfurt, Germany.
Zang, HM., Wang, F., Kang, Y.M., Chen, Y., and Lin, W. (Jul. 2007) *Microcup® e-Paper for Embedded and Flexible Designs*. IDMC'07, Taipei International Convention Center, Taiwan.
Zang, HM., Wang, W., Sun, C., Gu, H., and Chen, Y. (May 2006) Monochrome and Area Color Microcup® EPDs by Roll-to-Roll Manufacturing Processes. *ICIS ' 06 International Congress of Imaging Science Final Program and Proceedings*, pp. 362-365.
U.S. Appl. No. 12/046,197, Mar. 11, 2008, Wang et al.
U.S. Appl. No. 12/115,513, May 5, 2008, Sprague et al.
U.S. Appl. No. 13/004,763, Jan. 11, 2011, Lin et al.
U.S. Appl. No. 13/289,403, Nov. 4, 2011, Lin, et al.
Sprague, R.A. (May 18, 2011) *Active Matrix Displays for e-Readers Using Microcup Electrophoretics*. Presentation conducted at SID 2011, 49 Int'l Symposium, Seminar and Exhibition, May 15-May 20, 2011, Los Angeles Convention Center, Los Angeles, CA, USA.
U.S. Appl. No. 12/632,540, Office Action dated Jun. 7, 2012.
U.S. Appl. No. 13/471,004, May 14, 2012, Sprague et al.
U.S. Appl. No. 13/597,089, Aug. 28, 2012, Sprague et al.

* cited by examiner

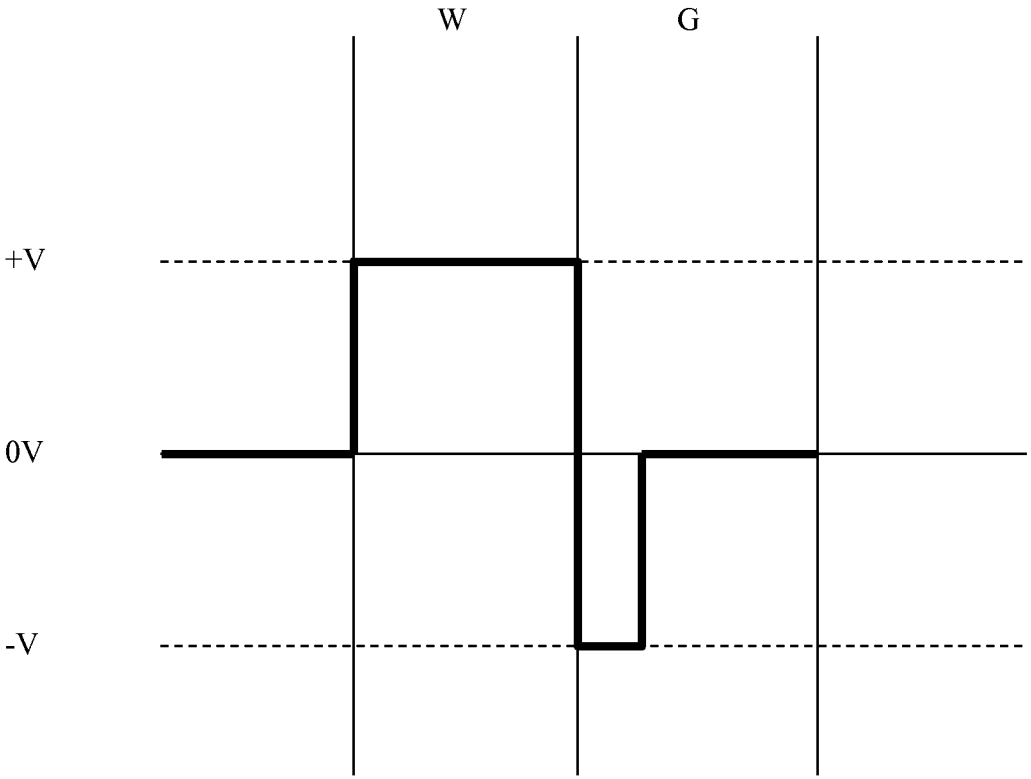
Figure 5a: WG Waveform Bipolar

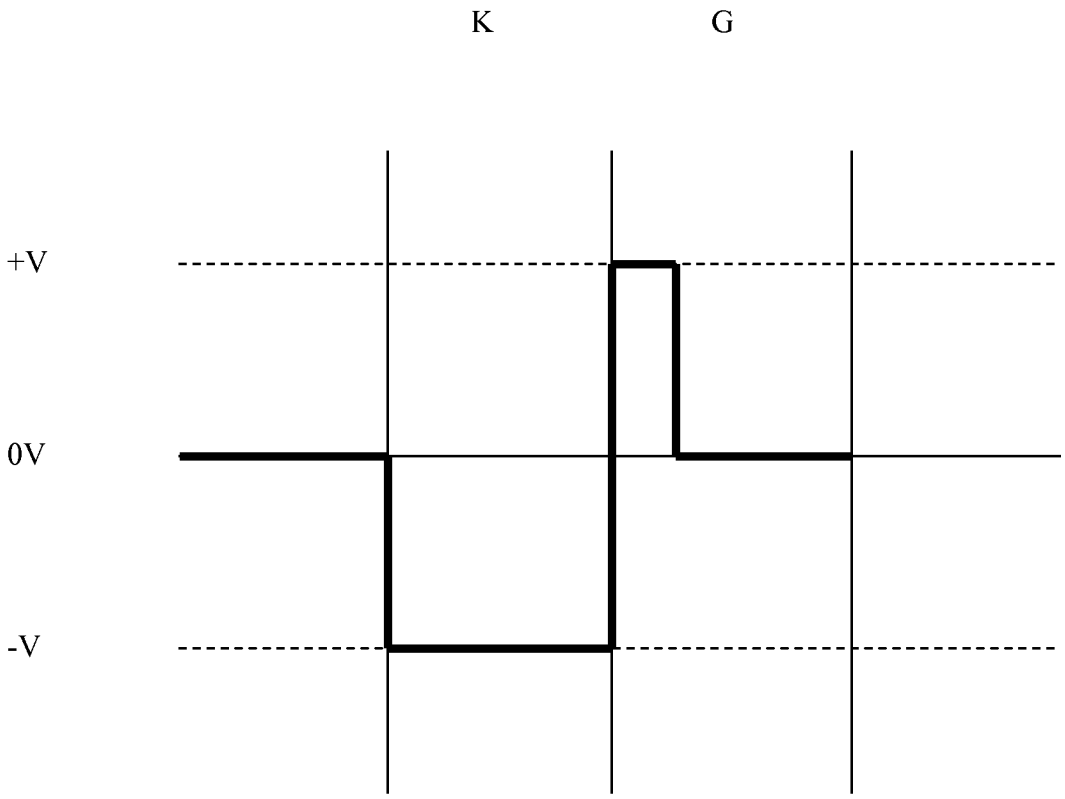
Figure 5b: KG Waveform Bipolar

DRIVING METHODS FOR ELECTROPHORETIC DISPLAYS EMPLOYING GREY LEVEL WAVEFORMS

This application is a continuation-in-part of U.S. application Ser. No. 12/632,540, filed Dec. 7, 2009 now U.S. Pat. No. 8,558,855, which is a continuation-in-part of the U.S. application Ser. No. 12/604,788, filed Oct. 23, 2009 now abandonded, which claims the benefit of U.S. Provisional Application Nos. 61/108,468, filed Oct. 24, 2008; and 61/108,440, filed Oct. 24, 2008; all of which are incorporated herein by reference in its entirety.

TECHNICAL FIELD

There is a strong desire to use microcup-based electrophoretic display front planes for e-books because they are easy to read (e.g., acceptable white levels, wide range of viewing angles, reasonable contrast, viewability in reflected light and paper-like quality) and require low power consumption. However, most of the driving methods developed to date are applicable to only binary black and white images. In order to achieve higher pictorial quality, grey level images are needed. The present invention presents driving methods for that purpose.

SUMMARY OF THE INVENTION

The first aspect of the invention is directed to a driving method for a display device having a binary color system comprising a first color and a second color, which method comprises a) applying a first waveform to drive a pixel to the full first color then to a color state of a desired level; or b) applying a second waveform to drive a pixel to the full second color then to a color state of a desired level.

In one embodiment of the first aspect of the invention, the first color and second colors are two contrasting colors. In one embodiment, the two contrasting colors are black and white. In one embodiment, mono-polar driving is used which comprises applying a waveform to a common electrode. In one embodiment, bi-polar driving is used which does not comprise applying a waveform to a common electrode.

In one embodiment of the first aspect of the invention, the pixel in a) may be further applied at least one driving voltage, before initiating the first waveform. In another embodiment, the pixel in a) may be further applied at least one driving voltage, between being driven to the full first color and being driven to the color state of a desired level. One of these two embodiments may occur or both embodiments may occur, in updating an image.

In another embodiment, the pixel in a) may be further applied at least one driving voltage during the pixel being driven to the full first color. In a further embodiment, the pixel in a) may be further applied at least one driving voltage during the pixel being driven to the color state of a desired level.

In one embodiment of the first aspect of the invention, the pixel in b) may be further applied at least one driving voltage, before initiating the second waveform. In another embodiment, the pixel in b) may be further applied at least one driving voltage, between being driven to the full second color and being driven to the color state of a desired level. One of these two embodiments may occur or both embodiments may occur, in updating an image.

In another embodiment, the pixel in b) may be further applied at least one driving voltage during the pixel being driven to the full second color. In a further embodiment, the pixel in b) may be further applied at least one driving voltage during the pixel being driven to the color state of a desired level.

The second aspect of the invention is directed to a driving method for a display device having a binary color system comprising a first color and a second color, which method comprises a) applying a first waveform to drive a pixel to the full first color state, then to the full second color state and finally to a color state of a desired level; or b) applying a second waveform to drive a pixel to the full second color state, then to the full first color state and finally to a color state of a desired level.

In one embodiment of the second aspect of the invention, the first color and second colors are two contrasting colors. In one embodiment, the two contrasting colors are black and white. In one embodiment, mono-polar driving is used which comprises applying a waveform to a common electrode. In one embodiment, bi-polar driving is used which does not comprise applying a waveform to a common electrode.

In one embodiment of the second aspect of the invention, the pixel in a) may be further applied at least one driving voltage, before initiating the first waveform. In another embodiment, the pixel in a) may be further applied at least one driving voltage, between being driven to the full first color and being driven to the full second color. In a further embodiment, the pixel in a) may be further applied at least one driving voltage, between being driven to the full second colors state and being driven to the color state of a desired level. One of these three embodiments may occur, or two of the three embodiments may occur, or all three embodiments may occur, in updating an image.

In another embodiment, the pixel in a) may be further applied at least one driving voltage during the pixel being driven to the full first color. In a further embodiment, the pixel in a) may be further applied at least one driving voltage during the pixel being driven to the full second color. In yet a further embodiment, the pixel in a) may be further applied at least one driving voltage during the pixel being driven to the color state of a desired level.

In one embodiment of the second aspect of the invention, the pixel in b) may be further applied at least one driving voltage, before initiating the second waveform. In another embodiment, the pixel in b) may be further applied at least one driving voltage, between being driven to the full second color and being driven to the full first color. In a further embodiment, the pixel in b) may be further applied at least one driving voltage, between being driven to the full first color and being driven to the color state of a desired level. One of these three embodiments may occur, or two of the three embodiments may occur, or all three embodiments may occur, in updating an image.

In another embodiment, the pixel in b) may be further applied at least one driving voltage during the pixel being driven to the full second color. In a further embodiment, the pixel in b) may be further applied at least one driving voltage during the pixel being driven to the full first color. In yet a further embodiment, the pixel in b) may be further applied at least one driving voltage during the pixel being driven to the color state of a desired level.

BRIEF DESCRIPTION OF THE DRAWINGS

FIGS. 5*a* and 5*b* show two bi-polar driving waveforms.

DETAILED DESCRIPTION OF THE INVENTION

Figure 1:
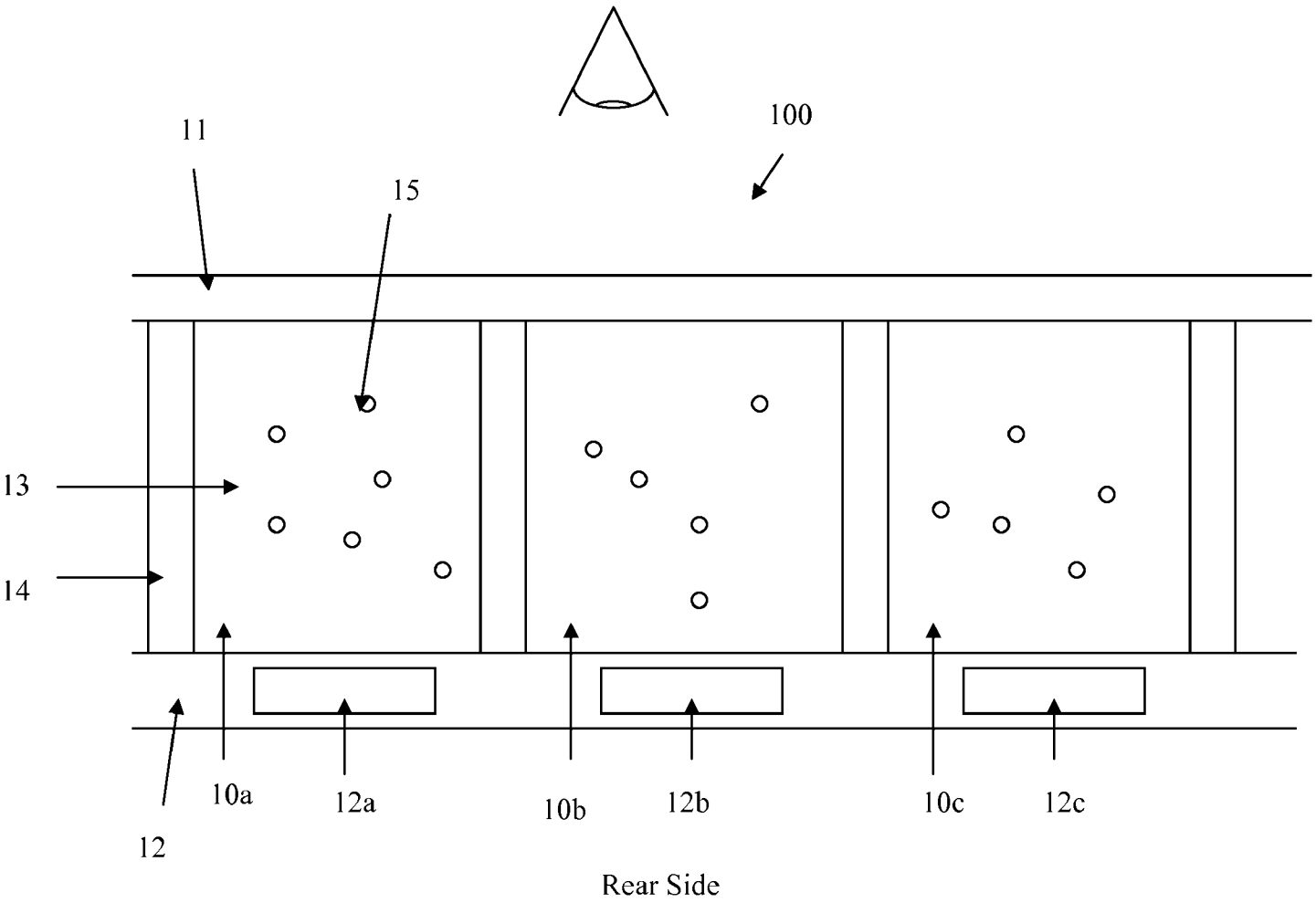
FIG. 1 depicts a typical electrophoretic display device.

FIG. 1 illustrates an electrophoretic display (100) which may be driven by any of the driving methods presented herein. In FIG. 1, the electrophoretic display cells 10*a*, 10*b*, 10*c*, on the front viewing side indicated with a graphic eye, are provided with a common electrode 11 (which is usually transparent and therefore on the viewing side). On the opposing side (i.e., the rear side) of the electrophoretic display cells 10*a*, 10*b* and 10*c*, a substrate (12) includes discrete pixel electrodes 12*a*, 12*b* and 12*c*, respectively. Each of the pixel electrodes 12*a*, 12*b* and 12*c* defines an individual pixel of the electrophoretic display. Although the pixel electrodes are shown aligned with the display cells, in practice, a plurality of display cells (as a pixel) may be associated with one discrete pixel electrode.

It is also noted that the display device may be viewed from the rear side when the substrate 12 and the pixel electrodes are transparent.

An electrophoretic fluid 13 is filled in each of the electrophoretic display cells. Each of the electrophoretic display cells is surrounded by display cell walls 14.

The movement of the charged particles 15 in a display cell is determined by the voltage potential difference applied to the common electrode and the pixel electrode associated with the display cell in which the charged particles are filled.

As an example, the charged particles 15 may be positively charged so that they will be drawn to a pixel electrode or the common electrode, whichever is at an opposite voltage potential from that of charged particles. If the same polarity is applied to the pixel electrode and the common electrode in a display cell, the positively charged pigment particles will then be drawn to the electrode which has a lower voltage potential.

In this application, the term "driving voltage" is used to refer to the voltage potential difference experienced by the charged particles in the area of a pixel. The driving voltage is the potential difference between the voltage applied to the common electrode and the voltage applied to the pixel electrode. As an example, in a single particle system, positively charged white particles are dispersed in a black solvent. When zero voltage is applied to a common electrode and a voltage of +15V is applied to a pixel electrode, the "driving voltage" for the charged pigment particles in the area of the pixel would be +15V. In this case, the driving voltage would move the positively charged white particles to be near or at the common electrode and as a result, the white color is seen through the common electrode (i.e., the viewing side). Alternatively, when zero voltage is applied to a common electrode and a voltage of −15V is applied to a pixel electrode, the driving voltage in this case would be −15V and under such −15V driving voltage, the positively charged white particles would move to be at or near the pixel electrode, causing the color of the solvent (black) to be seen at the viewing side.

In another embodiment, the charged pigment particles 15 may be negatively charged.

In a further embodiment, the electrophoretic display fluid could also have a transparent or lightly colored solvent or solvent mixture and charged particles of two different colors carrying opposite charges, and/or having differing electrokinetic properties. For example, there may be white pigment particles which are positively charged and black pigment particles which are negatively charged and the two types of pigment particles are dispersed in a clear solvent or solvent mixture.

The charged particles 15 may be white. Also, as would be apparent to a person having ordinary skill in the art, the charged particles may be dark in color and are dispersed in an electrophoretic fluid 13 that is light in color to provide sufficient contrast to be visually discernable.

The term "display cell" is intended to refer to a microcontainer which is individually filled with a display fluid. Examples of "display cell" include, but are not limited to, microcups, microcapsules, micro-channels, other partition-typed display cells and equivalents thereof.

In the microcup type, the electrophoretic display cells 10*a*, 10*b*, 10*c* may be sealed with a top sealing layer. There may also be an adhesive layer between the electrophoretic display cells 10*a*, 10*b*, 10*c* and the common electrode 11.

Figure 2:
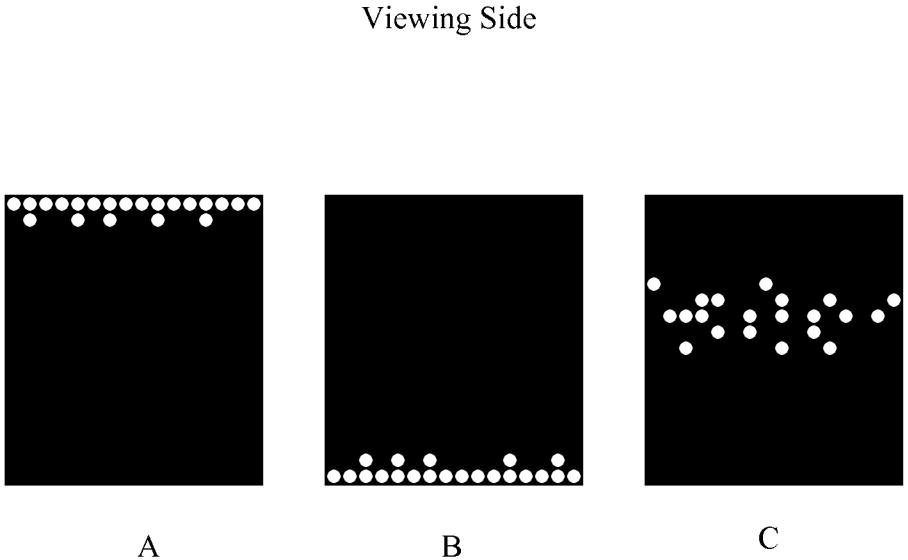
FIG. 2 illustrates an example of an electrophoretic display having a binary color system.

FIG. 2 is an example of a binary color system in which white particles are dispersed in a black-colored solvent. The term "binary color system" refers to a color system has two extreme color states (i.e., the first color and the second color) and a series of intermediate color states between the two extreme color states.

In FIG. 2A, while the white particles are at the viewing side, the white color is seen.

In FIG. 2B, while the white particles are at the bottom of the display cell, the black color is seen.

In FIG. 2C, the white particles are scattered between the top and bottom of the display cell, an intermediate color is seen. In practice, the particles spread throughout the depth of the cell or are distributed with some at the top and some at the bottom. In this example, the color seen would be grey (i.e., an intermediate color).

While black and white colors are used in the application for illustration purpose, it is noted that the two colors can be any colors as long as they show sufficient visual contrast. As stated above, the two colors in a binary color system may also be referred to as a first color and a second color and an intermediate color is a color between the first and second colors. The intermediate color has different degrees of intensity, on a scale between two extremes, i.e., the first and second colors. Using the grey color as an example, it may have a grey scale of 8, 16, 64, 256 or more. In a grey scale of 8, grey level 0 may be a white color and grey level 7 may be a black color. Grey levels 1-6 are grey colors ranging from light to dark.

Figure 3A:
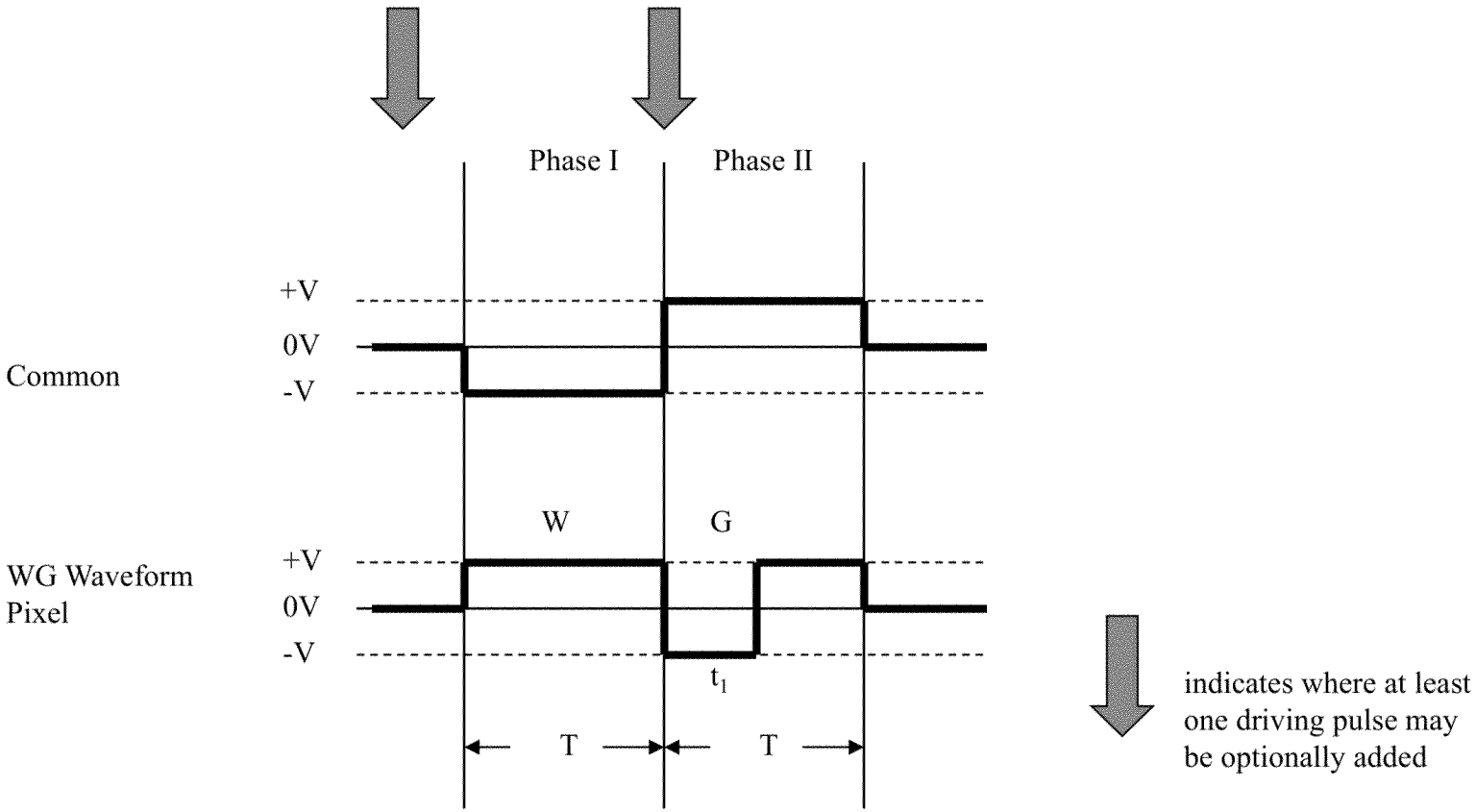
FIGS. 3*a* and 3*b* show two mono-polar driving waveforms.
Figure 3B:
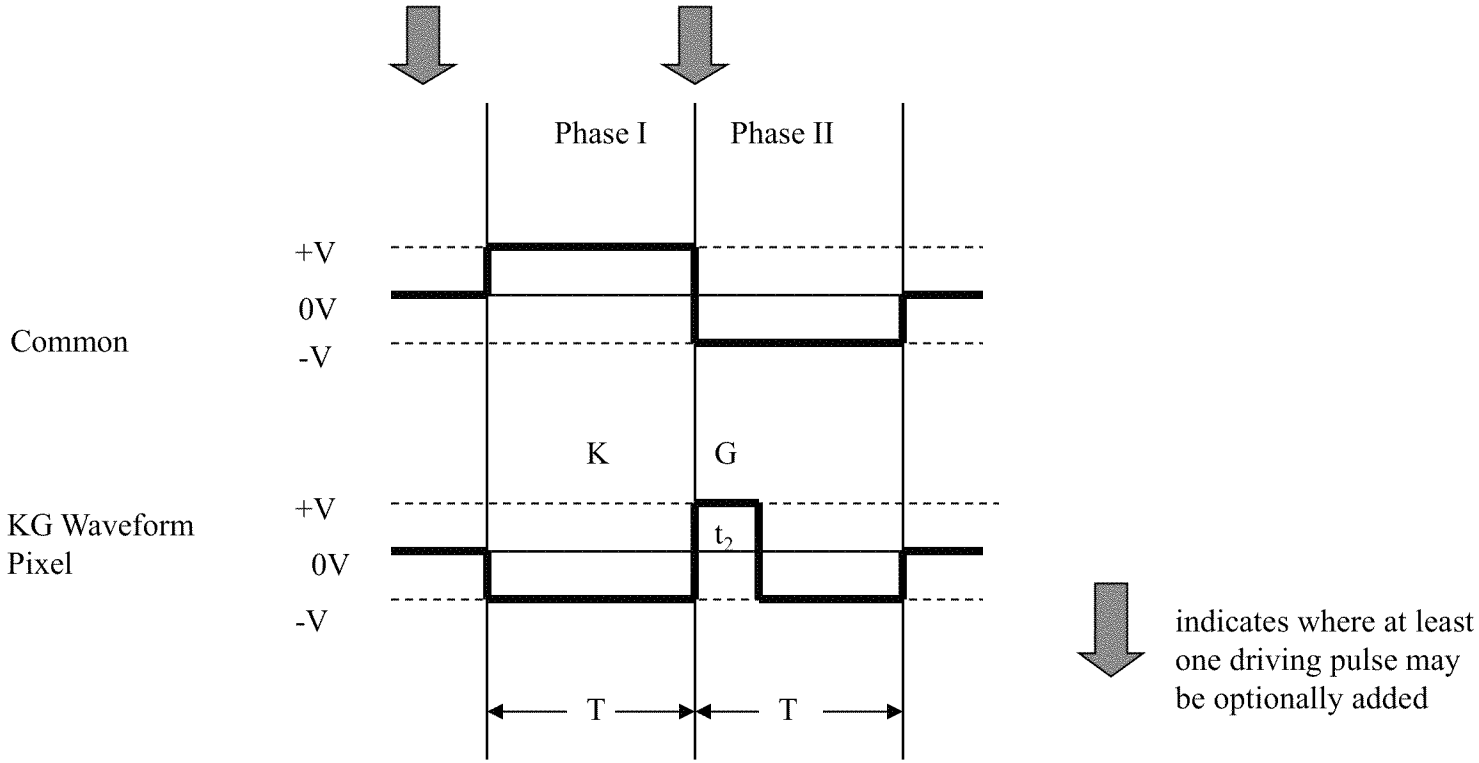

FIGS. 3*a* and 3*b* show two driving waveforms WG and KG, respectively. As shown the waveforms have two driving phases (I and II). Each driving phase has a driving time of equal length, T, which is sufficiently long to drive a pixel to a full white or a full black state, regardless of the previous color state.

For brevity, in both FIGS. 3*a* and 3*b*, each driving phase is shown to have the same length of T. However, in practice, the time taken to drive to the full color state of one color may not be the same as the time taken to drive to the full color state of another color. For illustration purpose, FIGS. 3*a* and 3*b* represent an electrophoretic fluid comprising positively charged white pigment particles dispersed in a black solvent.

In FIG. 3*a*, the common electrode is applied a voltage of −V and +V during Phase I and II, respectively. For the WG waveform, during Phase I, the common electrode is applied a voltage of −V and the pixel electrode is applied a voltage of +V, resulting a driving voltage of +2V and as a result, the positively charged white pigment particles move to be near or at the common electrode, causing the pixel to be seen in a white color. During Phase II, a voltage of +V is applied to the common electrode and a voltage of −V is applied to the pixel electrode for a driving time duration of $t_1$. If the time duration $t_1$ is 0, the pixel would remain in the white state. If the time duration $t_1$ is T, the pixel would be driven to the full black state. If the time duration $t_1$ is between 0 and T, the pixel would be in a grey state and the longer $t_1$ is, the darker the grey color. After $t_1$ in Phase II, the driving voltage for the pixel is shown to be 0V and as a result, the color of the pixel would remain in the same color state as that at the end of $t_1$ (i.e., white, black or grey). Therefore, the WG waveform is capable of driving a pixel to a full white (W) color state (in Phase I) and then to a black (K), white (W) or grey (G) state (in Phase II).

For the KG waveform in FIG. 3*b*, in Phase I, the common electrode is applied a voltage of +V while the pixel electrode is applied a voltage of −V, resulting in a −2V driving voltage, which drives the pixel to the black state. In Phase II, the common electrode is applied a voltage of −V and the pixel electrode is applied a voltage of +V for a driving time duration of $t_2$. If the time duration $t_2$ is 0, the pixel would remain in the black state. If the time duration $t_2$ is T, the pixel would be driven to the full white state. If the time duration $t_2$ is between 0 and T, the pixel would be in a grey state and the longer $t_1$ is, the lighter the grey color. After $t_2$ in Phase II, the driving voltage is 0V, thus allowing the pixel to remain in the same color state as that at the end of $t_2$. Therefore, the KG waveform is capable of driving a pixel to a full black (K) state (in Phase I) and then to a black (K), white (W) or grey (G) state (in Phase II).

In one embodiment, the term "full color state" may refer to a state where the color has the highest intensity possible of that color for a particular display device.

In one embodiment, the term "full color state", when referring to the white color state, may also encompass a white color which is within 5%, preferably within 2%, more preferably within 1%, of the reflectance of the fully saturated white color state.

In one embodiment, the term "full color state", when referring to the black color state, may also encompass a black color which is within 5%, preferably within 2%, more preferably within 1%, of the reflectance of the fully saturated black color state.

In one embodiment, if the color state is not white or black (e.g., red, green or blue), then the term "full color state" would indicate a particular color which is within 10, preferably 5, color saturation units from the maximum saturation.

Either one of the two waveforms (WG and KG) can be used to generate a grey level image as long as the lengths ($t_1$ or $t_2$) of the grey pulses are correctly chosen for the grey levels to be generated.

Therefore the first aspect of the present invention is directed to a driving method for a display device having a binary color system comprising a first color and a second color, which method comprises a) applying a first waveform to drive a pixel to the full first color state then to a color state of a desired level, or b) applying a second waveform to drive a pixel to the full second color state then to a color state of a desired level.

In the WG waveform as shown in FIG. 3*a*, each of the pixels is driven to the full white color state and then to a color state of a desired level. In other words, some pixels are driven to the full white state and then to black, some to the full white state and remain white, some to the full white state and then to grey level 1, some to the full white state and then to grey level 2, and so on, depending on the images to be displayed.

In the KG waveform as shown in FIG. 3*b*, each of the pixels is driven to the full black color state and then to a color state of a desired level. In other words, some pixels are driven to the full black state and then to white, some to the full black state and remain black, some to the full black state and then to grey level 1, some to the full black state and then to grey level 2, and so on, depending on the images to be displayed.

The term "a color state of a desired level" is intended to refer to either the first color state, the second color state or an intermediate color state between the first and second color states.

The first aspect of the present invention also encompasses the following embodiments:

In one embodiment of the first aspect of the invention, the pixel in a) may be further applied at least one driving voltage, before initiating the first waveform. In another embodiment, the pixel in a) may be further applied at least one driving voltage, between being driven to the full first color and being driven to the color state of a desired level. One of these two embodiments may occur or both embodiments may occur in updating an image.

In another embodiment, the pixel in a) may be further applied at least one driving voltage during the pixel being driven to the full first color. In a further embodiment, the pixel in a) may be further applied at least one driving voltage during the pixel being driven to the color state of a desired level.

In one embodiment of the first aspect of the invention, the pixel in b) may be further applied at least one driving voltage, before initiating the second waveform. In another embodiment, the pixel in b) may be further applied at least one driving voltage, between being driven to the full second color and being driven to the color state of a desired level. One of these two embodiments may occur or both embodiments may occur, in updating an image.

In another embodiment, the pixel in b) may be further applied at least one driving voltage during the pixel being driven to the full second color. In a further embodiment, the pixel in b) may be further applied at least one driving voltage during the pixel being driven to the color state of a desired level.

Figure 4A:
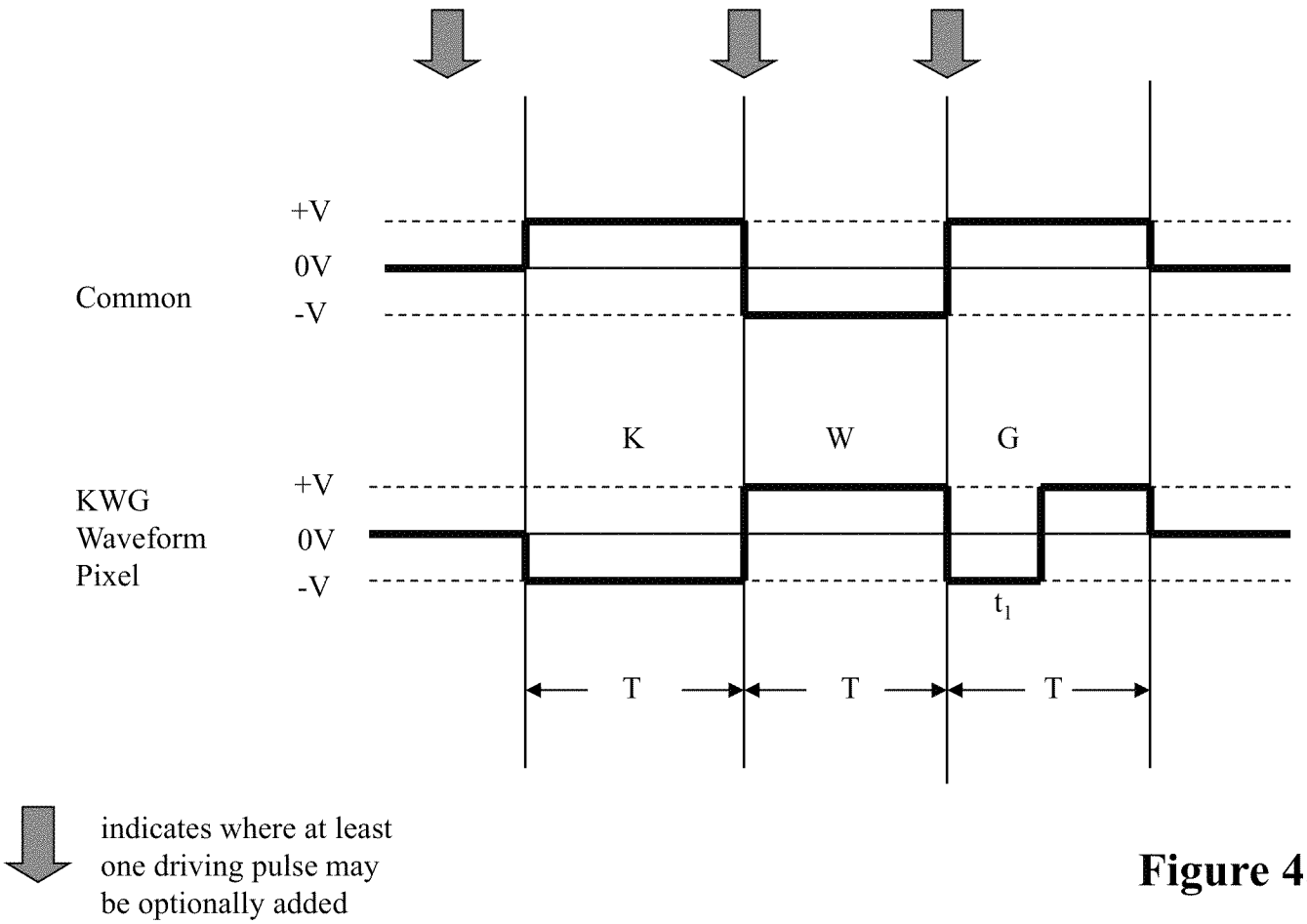
FIGS. 4*a* and 4*b* show alternative mono-polar driving waveforms.
Figure 4B:
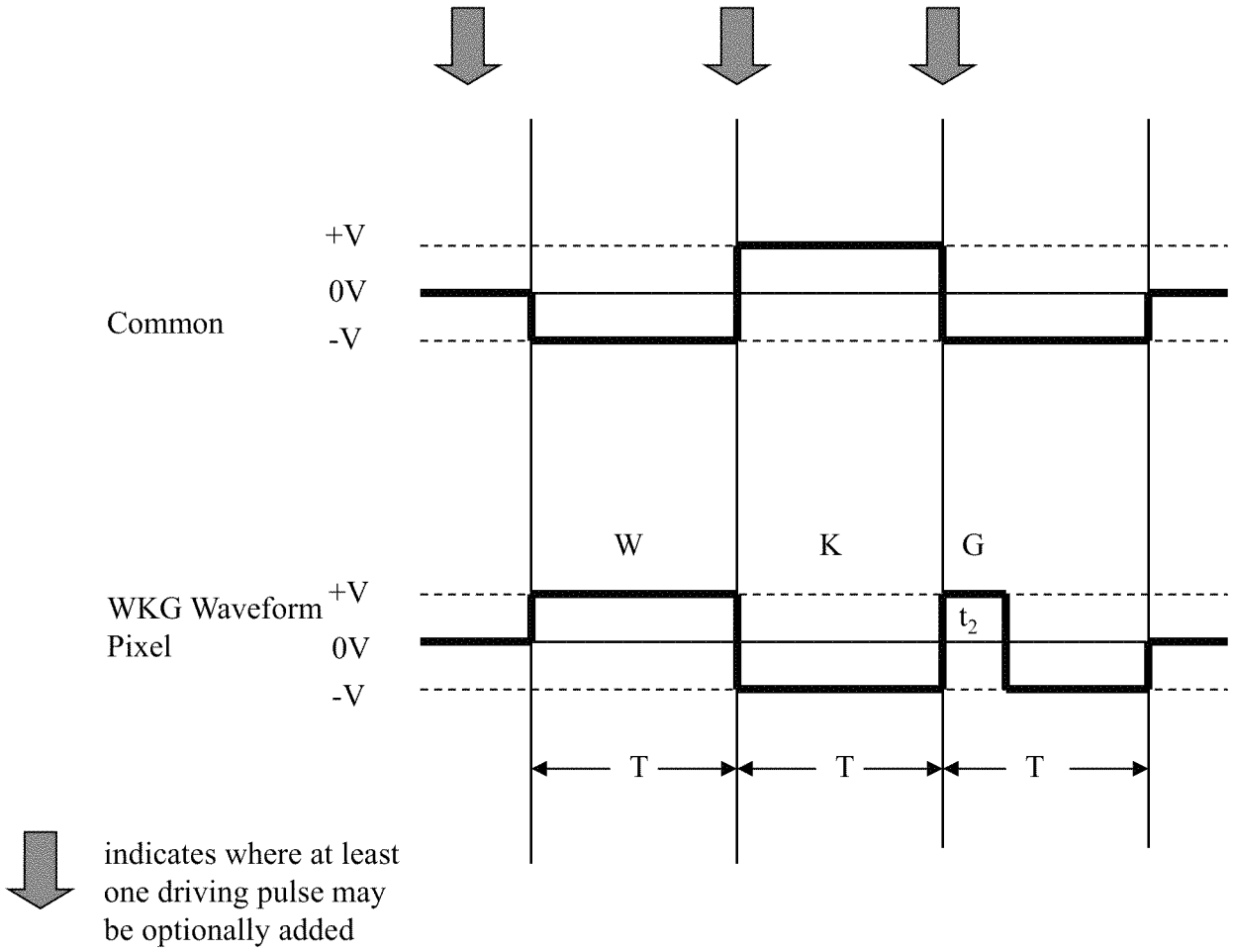

FIGS. 4*a* and 4*b* show alternative mono-polar driving waveforms. As shown, there are two driving waveforms, WKG waveform and KWG waveform.

The WKG waveform drive each of pixels, to the full white state, then to the full black state and finally to a color state of a desired level. The KWG waveform, on the other hand, drives each of pixels, to the full black state, then to the full white state and finally to a color state of a desired level.

Therefore the second aspect of the present invention is directed to the driving method as demonstrated in FIGS. 4*a* and 4*b* which may be generalized as follows:

A driving method for a display device having a binary color system comprising a first color and a second color, which method comprises a) applying a first waveform to drive a pixel to the full first color state, then to the full second color state and finally to a color state of a desired level; or b) applying a second waveform to drive a pixel to the full second color state, then to the full first color state and finally to a color state of a desired level.

The second aspect of the invention also encompasses the following embodiments:

In one embodiment of the second aspect of the invention, the pixel in a) may be further applied at least one driving voltage, before initiating the first waveform. In another embodiment, the pixel in a) may be further applied at least one driving voltage, between being driven to the full first color and being driven to the full second color. In a further embodiment, the pixel in a) may be further applied at least one driving voltage, between being driven to the full second colors state and being driven to the color state of a desired level. One of these three embodiments may occur, or two of the three embodiments may occur, or all three embodiments may occur, in updating an image.

In another embodiment, the pixel in a) may be further applied at least one driving voltage during the pixel being driven to the full first color. In a further embodiment, the pixel in a) may be further applied at least one driving voltage during the pixel being driven to the full second color. In yet a further embodiment, the pixel in a) may be further applied at least one driving voltage during the pixel being driven to the color state of a desired level.

In one embodiment of the second aspect of the invention, the pixel in b) may be further applied at least one driving voltage, before initiating the second waveform. In another embodiment, the pixel in b) may be further applied at least one driving voltage, between being driven to the full second color and being driven to the full first color. In a further embodiment, the pixel in b) may be further applied at least one driving voltage, between being driven to the full first color and being driven to the color state of a desired level. One of these three embodiments may occur, or two of the three embodiments may occur, or all three embodiments may occur, in updating an image.

In another embodiment, the pixel in b) may be further applied at least one driving voltage during the pixel being driven to the full second color. In a further embodiment, the pixel in b) may be further applied at least one driving voltage during the pixel being driven to the full first color. In yet a further embodiment, the pixel in b) may be further applied at least one driving voltage during the pixel being driven to the color state of a desired level.

The bi-polar approach requires no modulation of the common electrode while the mono-polar approach requires modulation of the common electrode.

The present method may also be run on a bi-polar driving scheme. The two bi-polar waveforms WG and KG are shown in FIG. 5*a* and FIG. 5*b*, respectively. The bi-polar WG and KG waveforms can run independently without being restricted to the shared common electrode.

In practice, the common electrode and the pixel electrodes are separately connected to two individual circuits and the two circuits in turn are connected to a display controller. The display controller issues signals to the circuits to apply appropriate voltages to the common and pixel electrodes respectively. More specifically, the display controller, based on the images to be displayed, selects appropriate waveforms and then issues signals, frame by frame, to the circuits to execute the waveforms by applying appropriate voltages to the common and pixel electrodes. In the case of bi-polar driving, the common electrode is grounded or applied a DC shift voltage. The term "frame" represents timing resolution of a waveform.

The pixel electrodes may be a TFT (thin film transistor) backplane.

EXAMPLES

Figure 6:
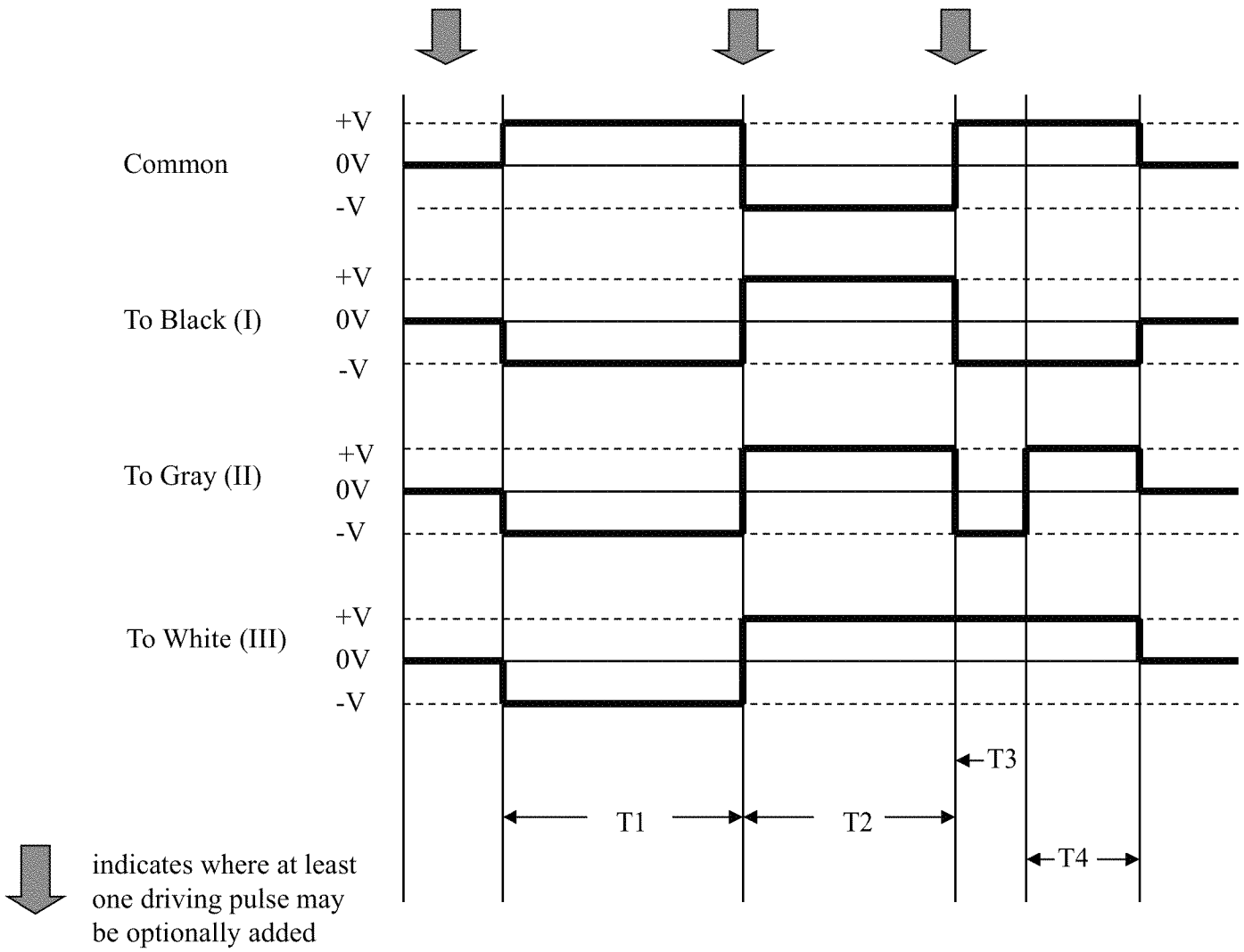
FIG. 6 is an example of waveforms of the present invention.

FIG. 6 represents a driving method of the present invention which comprises four driving phases (T1, T2, T3 and T4) of the KWG waveform. In this example, the durations for T1, T2, T3 and T4 are 500 msec, 600 msec, 180 msec and 320 msec, respectively.

The top waveform represents the voltages applied to the common electrode and the three waveforms below (I, II and III) represent how pixels may be driven to the black state, a grey state and the white state, respectively.

The voltage for the common electrode is set at +V in driving frame T1, −V in T2 and +V in T3 and T4.

In order to drive a pixel to the black state (waveform I), the voltage for the corresponding discrete electrode is set at −V in T1, +V in T2 and −V in T3 and T4.

In order to drive a pixel to a grey level (waveform II), the voltage for the corresponding discrete electrode is set at −V in T1, +V in T2, −V in T3 and +V in T4.

In order to drive a pixel to the white state (waveform III), the voltage for the corresponding discrete electrode is set at −V in T1 and +V in T2, T3 and T4.

Figure 7:
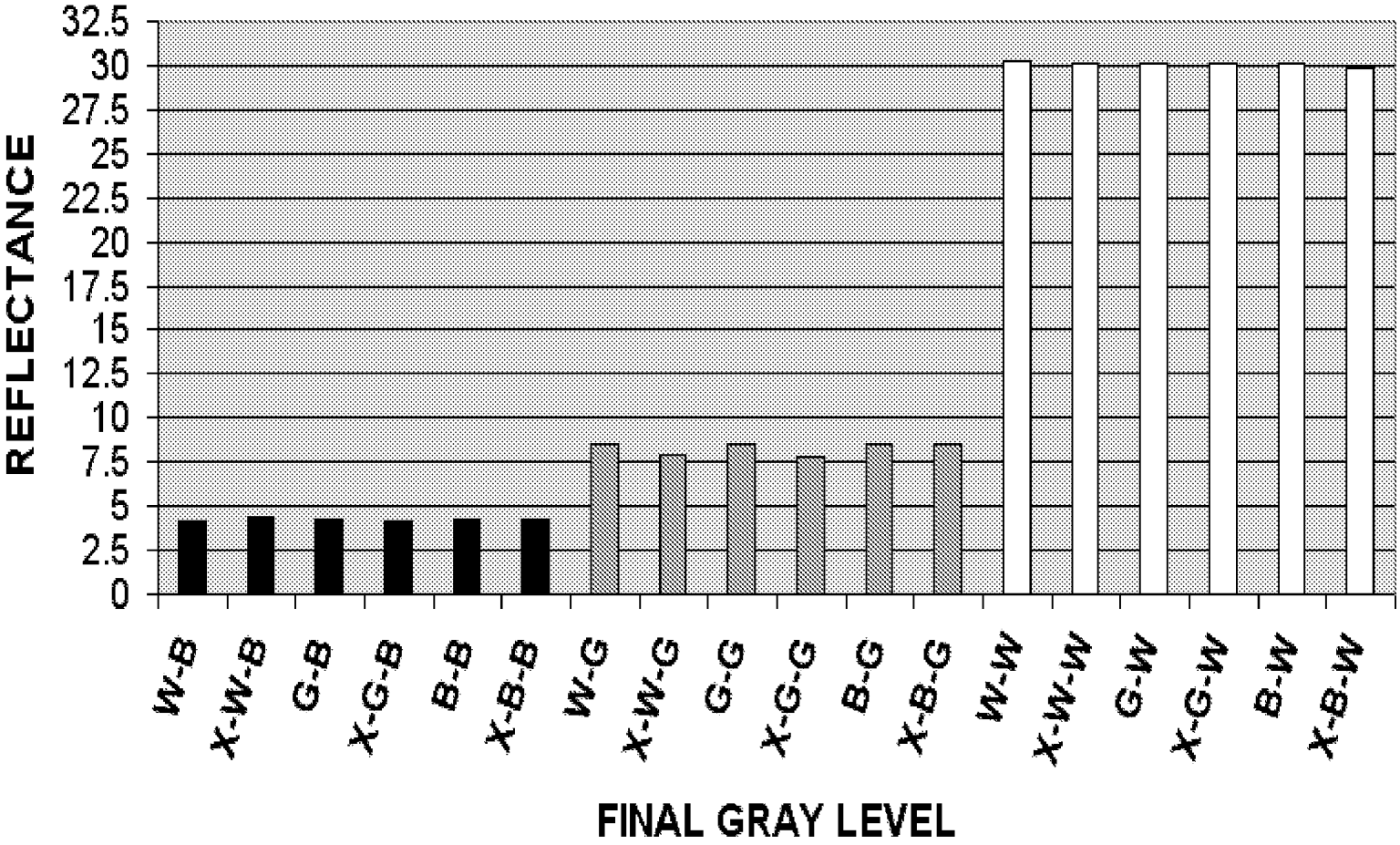
FIG. 7 shows repeatability of the reflectance achieved by the example waveforms.

FIG. 7 shows the consistency of reflectance levels achieved by the driving method of the example. The notations "W", "B", "G", and "X" refers to the white state, black state, a grey level and any color state, respectively.

Figure 8:
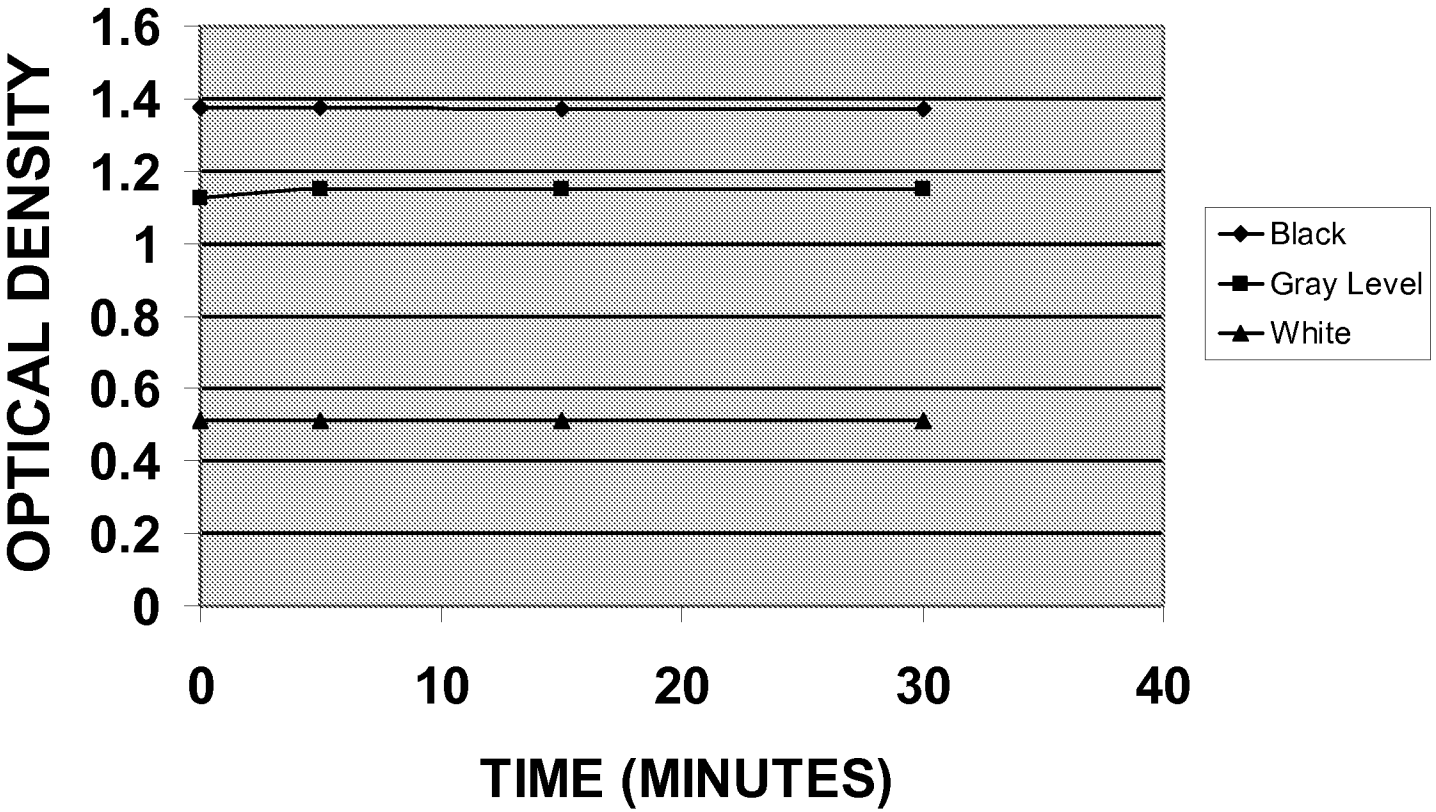
FIG. 8 demonstrates the bistability of images achieved by the example waveforms.

FIG. 8 demonstrates the bistability of the images achieved.

While the present invention has been described with reference to the specific embodiments thereof, it should be understood by those skilled in the art that various changes may be made and equivalents may be substituted without departing from the true spirit and scope of the invention. In addition, many modifications may be made to adapt a particular situation, materials, compositions, processes, process step or steps, to the objective, spirit and scope of the present invention. All such modifications are intended to be within the scope of the claims appended hereto.

What is claimed is:

1. A driving method for an electrophoretic display device which comprises a plurality of pixels and has a color system comprising a first color state, a second color state and intermediate color states between the first color state and the second color state, the method comprising:

(i) applying a first driving pulse to drive a pixel of the plurality of pixels from an initial color state of the pixel to the first color state, wherein the initial color state is selected from the group consisting of the first color state, the second color state and the intermediate color states and the first driving pulse is applied for a predetermined length of time which is the same regardless of the initial color state of the pixel; and (ii) applying a second driving pulse to drive the pixel to a color state of a desired level, wherein the first driving pulse and the second driving pulse have the same magnitude, but opposite polarities.

2. The driving method of claim 1, wherein the first color state is black and the second color state is white, or vice versa.

3. The driving method of claim 1, which is driven by a mono-polar driving method.

4. The driving method of claim 1, which is driven by a bi-polar driving method.

5. The driving method of claim 1, further comprising applying at least one driving pulse before step (i).

6. The driving method of claim 1, further comprising applying at least one driving pulse between step (i) and step (ii).

7. A driving method for an electrophoretic display device which comprises a plurality of pixels and has a color system comprising a first color state, a second color state and intermediate color states between the first color state and the second color state, the method comprising:

(i) applying a first driving pulse to drive a pixel of the plurality of pixels from an initial color state of the pixel to the first color state, wherein the initial color state is selected from the group consisting of the first color state, the second color state and intermediate color states and the first driving pulse is applied for a first predetermined length of time which is the same regardless of the initial color state of the pixel;

(ii) applying a second driving pulse to drive the pixel to the second color state; and (iii) applying a third driving pulse to drive the pixel to a color state of a desired level wherein the first driving pulse, the second driving pulse and the third driving pulse have the same magnitude; but not all three have the samepolarities.

8. The driving method of claim 7, wherein in step (ii), the second driving pulse is applied for a second predetermined length of time which is the same regardless of the color state of the desired level in step (iii).

9. The driving method of claim 7, wherein the first color state is black and the second color state is white, or vice versa.

10. The driving method of claim 7, which is driven by a mono-polar driving method.

11. The driving method of claim 7, which is driven by a bi-polar driving method.

12. The driving method of claim 7, further comprising applying at least one driving pulse before step (i).

13. The driving method of claim 7, further comprising applying at least one driving pulse between step (i) and step (ii).

14. The driving method of claim 7, further comprising applying at least one driving pulse between step (ii) and step (iii).

* * * * *